United States Patent [19]

Olberz et al.

[11] 4,213,255

[45] Jul. 22, 1980

[54] SOLE FOR HIKING BOOTS AND THE LIKE

[75] Inventors: Norbert J. Olberz, 429 Starlight Crest Dr., La Canada, Calif. 91011; Artie Hagmueller, La Canada, Calif.

[73] Assignee: Norbert J. Olberz, La Canada, Calif. ; a part interest

[21] Appl. No.: 898,379

[22] Filed: Apr. 20, 1978

[51] Int. Cl.[2] ..... A43B 13/04

[52] U.S. Cl. ..... 36/32 R

[58] Field of Search ..... 36/32 R, 30 R, 14, 59 R, 36/59 C

[56] References Cited

U.S. PATENT DOCUMENTS

| | | | |
|---|---|---|---|
| 2,410,019 | 10/1946 | Davis | 36/32 R |
| 2,435,976 | 2/1948 | Monagin | 36/30 R |
| 4,060,917 | 12/1977 | Canale | 36/32 R |

FOREIGN PATENT DOCUMENTS

| | | | |
|---|---|---|---|
| 2733605 | 2/1978 | Fed. Rep. of Germany | 36/32 R |
| 1494331 | 7/1967 | France | 36/32 R |
| 1490219 | 10/1977 | United Kingdom | 36/32 R |

*Primary Examiner*—James Kee Chi

*Attorney, Agent, or Firm*—Christie, Parker, & Hale

[57] ABSTRACT

A sole for hiking boots is provided as an article of manufacture. The sole has a top surface and also a bottom tread surface which, intermediate the ends of the sole, is disposed in a sole base plane. At its rear end, the sole has a distinct substantially straight extent generally perpendicular to the length of the sole so that, when the sole is viewed in a direction substantially normal to the top surface, it has a substantially square heel. Adjacent the front and rear ends of the sole, the tread surface is cylindrically curved concave upwardly away from the base plane proceeding toward the adjacent ends of the sole. The directrix of each of these cylinders is substantially parallel to the sole base plane and substantially perpendicular to the length of the sole.

18 Claims, 8 Drawing Figures

SOLE FOR HIKING BOOTS AND THE LIKE

FIELD OF THE INVENTION

This invention pertains to soles for boots and shoes. More particularly, it pertains to a sole for hiking boots in which the heel, when viewed in plan view, is substantially square at its rear end and in which the sole tread surface adjacent the ends of the sole are curved cylindrically away from a base plane of the sole.

BACKGROUND OF THE INVENTION

Review of the Prior Art

Soles for hiking boots and the like are presently fabricated as distinct articles of manufacture for sale to various boot fabricators. The soles are affixed, as by sewing, gluing or the like, to an upper portion of a shoe or boot in a terminal stage of manufacture of the boot.

Hiking boots of various styles and designs are presently commercially available essentially worldwide. The general objective of a hiking boot is to provide sufficient support for the foot of a hiker that the hiker does not become tired when walking long distances over various terrains. For example, if a person is hiking a long distance wearing shoes such as tennis shoes which are very flexible both in the soles and in the uppers, the hiker rapidly becomes tired. This is due to the extreme flexibility of the shoe which results in the foot muscles, and also the muscles in the ankle, being flexed and worked as walking occurs. In a hiking boot, on the other hand, the sole of the boot is substantially stiffer than in a tennis shoe and provides substantially greater support for the ankle. As a result, during walking while wearing a hiking boot, the foot muscles are flexed and worked to a substantially reduced degree, with the result that the foot muscles are not so rapidly fatigued.

The soles of prior hiking boots, when seen in plan view (i.e., in a direction perpendicular to the bottom of the sole), have rounded rear ends and when viewed in elevation, have a vertical or substantially vertical rear profile. This heel configuration means that, in normal walking, the initial contact between the boot sole and the ground occurs essentially at a point. The boot can pivot about this point before the remainder of the sole tread surface engages the ground. When walking on rough terrain, as on rocky surfaces, it is not uncommon for the boot to pivot in an undesired manner, thereby placing strain on the muscles associated with the ankle. If of a modest level, such strains result in tiring of the ankle muscles, and if extreme, can result in an ankle sprain. Also, this configuration of prior hiking boot soles results in shocks being applied to the hiker, further tiring the hiker.

Inasmuch as the basic objective of a hiking boot is to protect the hiker from injury, as by sprained ankles and the like, and also to minimize working of the foot and ankle muscles as walking occurs, it is apparent that the greater the extent to which the boot protects the hiker from muscle sprains, strains and fatigue, the better the design of the boot. The design of the boot sole is a significant aspect, if not a principal aspect of the boot in this regard. We have discerned that existing hiking boot sole designs can be substantially improved.

SUMMARY OF THE INVENTION

This invention provides an improved sole for use on hiking boots and the like. The sole is provided as a separate article of manufacture which is adapted to be connected to an upper of a boot in the last stages of manufacture of a boot. The improved sole features a heel configuration which substantially minimizes the impacts transmitted to the wearer of a boot as the boot makes initial contact with the ground during normal walking. Also, the heel configuration of the improved sole substantially reduces the tendency of the boot to pivot in undesired directions as the sole makes its initial contact with the ground during walking. The sole is so configured that the boot can be defined to hold the wearer's ankle substantially more firmly than has heretofore been possible. The sole is so shaped that the sole configuration itself effectively performs the rolling action, both on initial contact and on take-off from a step or stride, which would otherwise require flexing of the ankle and foot muscles during normal walking. Thus, the present sole makes it possible to construct a hiking boot which has substantially improved performance in terms of protecting the wearer from fatigue and injury while walking long distances over various terrains.

Generally speaking, this invention provides a sole member adapted to be affixed to an upper or body of a hiking boot and the like. The sole member has a heel portion at a rear end thereof and a toe portion at a front end thereof. The sole member also has a top surface and a bottom tread surface. The tread surface, between first and second locations intermediate the ends of the sole member, is disposed in a base plane of the sole member. The rear end of the sole member has a distinct, substantially straight extent which is disposed substantially perpendicular to the length of the sole member; this results in the sole member having a substantially square heel when viewed along a line substantially perpendicular to the top surface. The tread surface is curved concave upwardly proceeding rearwardly therealong from the rear one of said locations so that the heel portion, when the sole is viewed from the side along a line substantially parallel to the top surface, has a first curved configuration in which the tread surface extends substantially cylindrically curvilinearly away from the base plane substantially to the sole member top surface to the substantially straight extent of the sole member at the rear end thereof. Further, the tread surface is curved concave upwardly proceeding forwardly therealong from the forward one of said locations so that the toe portion, when the sole is viewed from the side, has a second curved configuration in which the tread surface extends curvilinearly away from the base plane substantially to the top surface. In use of a hiking boot and the like incorporating the sole member, the configuration of the tread surface affords substantially line contact between the sole and a ground surface and tends to direct the boot to roll straight ahead.

DESCRIPTION OF THE DRAWINGS

The above-mentioned and other features of this invention are more fully set forth in the following detailed description of several embodiments of the invention, including a presently preferred embodiment, which are illustrated in the accompanying drawings, wherein.

DESCRIPTION OF THE ILLUSTRATED EMBODIMENTS

Figure 1:
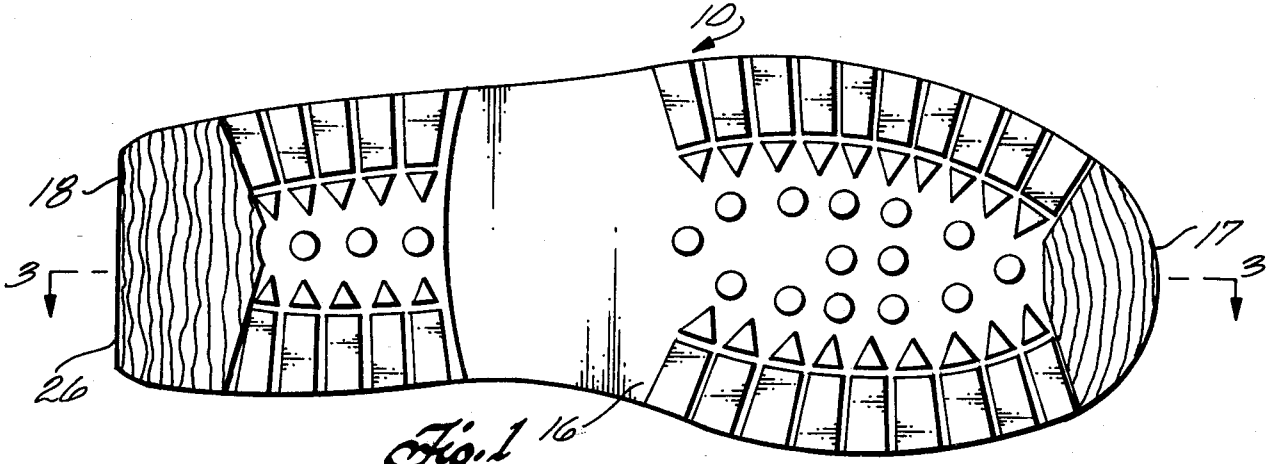
FIG. 1 is a bottom plan view of the presently preferred hiking boot sole.
Figure 2:
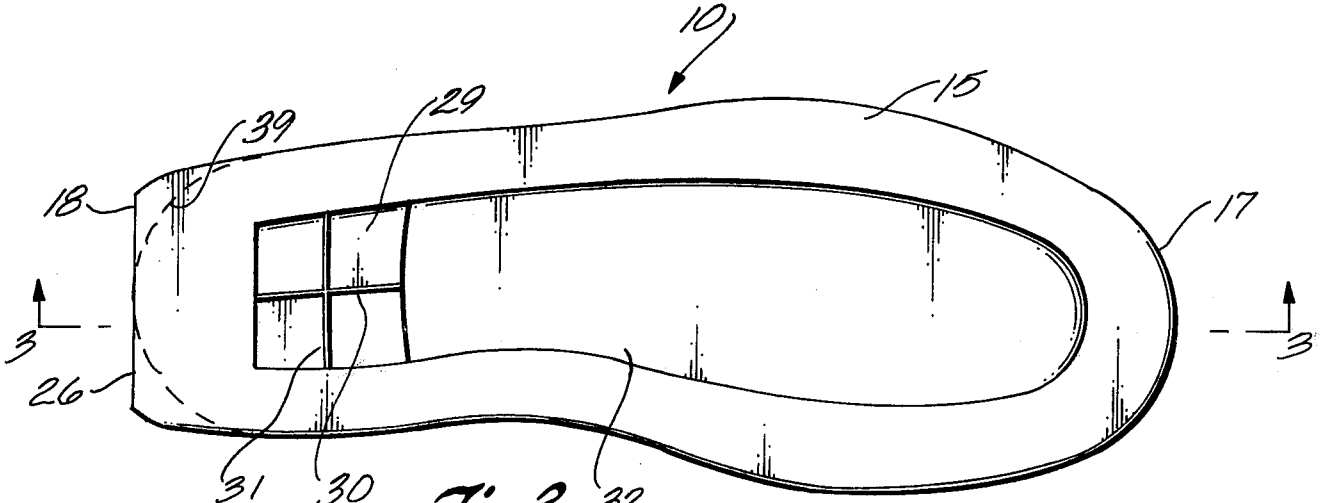
FIG. 2 is a top plan view of the sole shown in FIG. 1.
Figure 3:
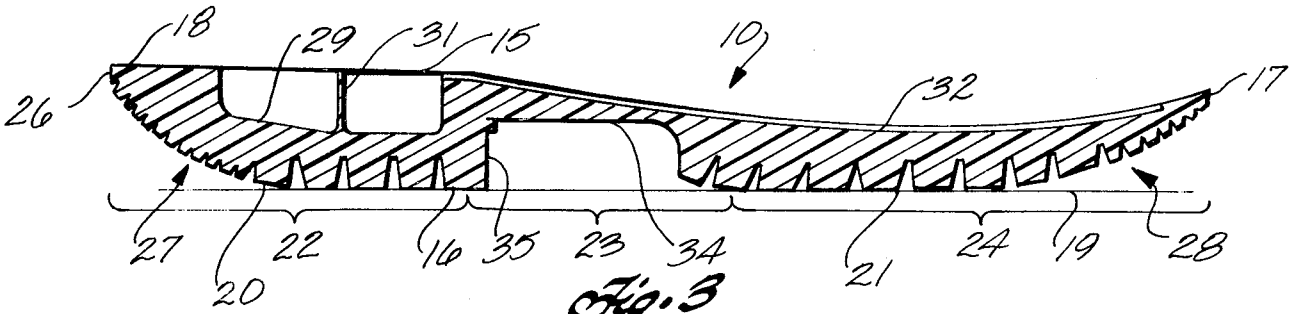
FIG. 3 is a longitudinal cross-sectional elevation view taken along lines 3—3 in FIGS. 1 and 2.
Figure 8:
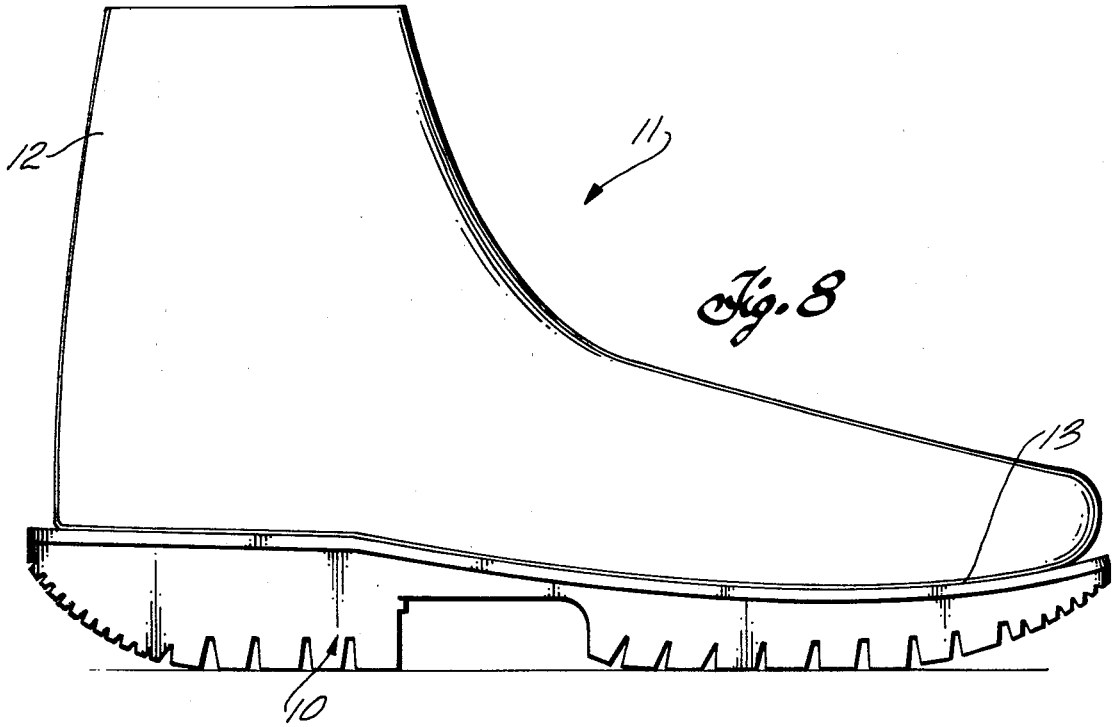
FIG. 8 is an elevation view of a hiking boot in which the sole shown in FIGS. 1-3 is a component.

A hiking boot sole 10, which is a presently preferred embodiment of this invention, is shown in FIGS. 1, 2 and 3. Sole 10 is provided as a marketable article of manufacture. The sole is used by a maker of a hiking boot 11 (see FIG. 8) as a component of the finished boot. Typically, the sole is affixed, as by gluing or sewing, to a middle sole element 13 of the boot. The middle sole is a component of a boot upper or body 12 which is built in a suitable last. The middle sole typically is incorporated into the upper prior to removal of the upper from the last, after which outer sole 10, according to this invention, is affixed to the boot. Typically, the middle sole is trimmed around its periphery to conform to the peripheral configuration of the outer sole after the outer sole has been attached to the upper.

As shown best in FIG. 3, sole 10 has a top surface 15 and a bottom tread surface 16. The top and tread surfaces extend along the length of the sole between a front toe end 17 and a rear heel end 18 of the sole member. For the purposes of description of the geometry of the sole, the sole is considered to have a base plane 19. Between first and second locations 20 and 21 adjacent the rear and front ends of the sole, the tread surface 16 is disposed in the base plane 19 of the sole. Also, sole 10 has a rear heel portion 22, a central arch portion 23, and a forward toe portion 24. The precise extents of the heel, arch and toe portions along the length of the sole are approximate and are represented in FIG. 3 principally to facilitate description of sole 10.

At its rear end 18, sole 10 has a distinct, substantially straight heel edge 26 which is aligned substantially perpendicular to the length of the sole. Edge 26 intersects sole top surface 15 and is defined at the upper terminal portion of a cylindrically curved heel configuration 27 of the sole; configuration 27 is defined in greater detail below. Edge 26 has an extent transversely of the sole which is a substantial fraction of the overall width of the sole. In a presently preferred embodiment of sole 10, the ratio of the length of edge 26 to the overall width of the sole is about 37:67. That is, edge 26 has an extent transversely of the length of the sole which is on the order of about one-half the width of the sole, or more.

In combination with the elongate straight rear heel edge of the sole, the sole has a curved heel configuration 27 which is shown best in FIG. 3. Configuration 27 is defined in the sole between location 20 and heel edge 26. Location 20 is defined as that location where configuration 27 merges into the portion of the tread surface which lies in the sole base plane. Configuration 27 preferably is defined in the rear part of heel portion 22 which, as noted above, is a general portion of the sole which has no precisely defined forward limit. Configuration 27 is defined by the tread surface rearwardly of location 20 being curved concave upwardly proceeding along the sole toward and to its heel end 18. Within the extent of configuration 27 along the length of the sole, the tread surface is cylindrically curved. In this regard, the term "cylindrical" is used in its broad mathematical sense to describe the curvature of the tread surface. That is, a cylinder is defined as the surface generated in space by a line, the generatrix, moving at all times parallel to another fixed line, the directrix. In the specific situation illustrated in FIG. 3 at 27, the directrix lies parallel to top surface 15 and generally perpendicular to the elongate extent of the sole, i.e., parallel to heel edge 26. Also as shown in FIG. 3, the curvature of the tread surface increases proceeding rearwardly from location 20 to heel edge 26. Preferably the heel edge is defined by a surface which is perpendicular to the sole based plane. If the thickness of the sole in heel portion 22, i.e., between the base plane and the top surface of the sole along the heel portion, is on the order of 1¼ inches as is preferred, the tread surface is perpendicular to the sole top surface for the last 3/16 inch or so of its extent below the line at which the top and tread surfaces intersect. It is preferred that the extent of configuration 27 along the length of the sole be on the order of about 1½ times the thickness of the sole through the heel portion.

The forward part of sole toe portion 24 has a curved configuration 28 which, when viewed from the side (see FIG. 3), is similar to heel configuration 27. That is, forwardly of location 21, tread surface 16 is cylindrically curved concave upward proceeding along the length of the sole toward toe end 17. The directrix of the cylindrical curvature of configuration 28 is parallel to the directrix of cylindrical heel configuration 27. If the distance between sole top surface 15 and base plane 19 at toe end 17 is on the order of 1-1/16 inches as preferred, the distance between the sole top surface and tread surface at the extreme toe end of the sole is on the order of 3/16 inch. Preferably, the vertical extent of configuration 28, i.e., the total departure of the tread surface from base plane 19 in a vertical direction, is on the order of one-third of the length of configuration 27 from location 21 to toe end 17. As shown in FIG. 3, it is preferred that the curvature of the tread surface increase progressively proceeding forwardly from location 21 where the curvature of the tread surface fairs into the base plane of the sole.

As shown in FIG. 3, sole top surface 15 is curved concave upward in a cylindrical manner over the portion of the length of the sole corresponding to the arch and toe sections 23 and 24. In the presently preferred sole shown in FIG. 3, the minimum distance between the top surface and the base plane is on the order of ⅝ inch. This is a relatively great thickness for a hiking boot sole. The sole preferably is molded of a relatively hard and inflexible rubber or rubber-like material. Accordingly, when the sole is incorporated into boot 11, the sole imparts substantial stiffness to the boot in the portion occupied by the ball of the foot in use of the boot. This increased stiffness of the boot in this area prevents the foot muscles in the area of the ball of the foot from being flexed appreciably as walking occurs, thereby minimizing fatigue of these foot muscles. The curved heel and toe configurations of sole 10, however, make it easier for the user of boot 11 to walk. Heel configuration 27 provides enhanced rolling action between the sole and the ground following initial contact of the sole with the ground in use of the boot, and toe configuration 27 enables the boot to roll along the ground to effectively roll out of a stride. It is therefore seen that rool-on heel configuration enables a user of the boot to roll into a stride even though his ankle muscles may effectively be locked by a firm construction of the boot upper; the toe configuration enables a user to effectively roll out of the stride by virtue of the stiffness of the sole in its forward portion, thereby simulating a locking of the muscles associated with the ball of the foot.

The substantial extent of heel edge 26 transversely of the sole affords line contact between the sole and the ground in use of boot 11, rather than point contact which is provided by existing hiking boot soles. This line contact assures a stable engagement of the sole with the ground upon the initiation of a step. The length of this line and the cylindrical heel configuration direct the boot to roll straight ahead. This minimizes the chance for the ankle to turn laterally or to buckle, thereby preventing either a strain or, more severely, a sprain of the ankle. This is a particularly advantageous feature when a boot incorporating sole 10 is used in rock climbing or on other hard or uneven terrain.

The fact that tread surface 16 lies in base plane 19 over at least a substantial portion of the length of the sole between locations 20 and 21 affords a stable foundation for a user of boot 11 when standing.

The overall effect of sole 10 is to impart to hiking boot 11 characteristics similar to those of a ski boot; a ski boot effectively holds the foot of a skier rigid at the ankle and below. The presence of the cylindrically curved heel and toe configurations of sole 10 enables this to be done without impairing the ability of the hiker to walk comfortably over great distances.

Persons familiar with the art to which this invention pertains will appreciate that sole 10 is substantially thicker than hiking boot soles previously provided. To reduce the overall weight of the sole, top surface 15 defines an upwardly open recess 29 in heel portion 22. To provide support for the heel of a user of the boot, the recess is bisected longitudinally and transversely by ribs 30 and 31 which have their upper extents coplanar with top surface 15. Forwardly of recess 29, top surface 15 defines a shallow recess 52 inwardly of its peripheral edges (see FIG. 2) which allows the middle sole of boot 11 to flex into and out of this recess as walking occurs, all for increased comfort.

In the presently preferred sole 10 shown in FIG. 3, a recess 34 is defined in tread surface 16 at arch portion 23. Recess 34 extends from side to side of the sole and has a rear wall 35 which is disposed substantially perpendicular to base plane 19. Arch recess 34 imparts to the sole member the effect of a built-up heel which is particularly desirable in a boot used in rock climbing and the like.

In a presently preferred form of sole 10, the distance between top surface 15 and the sole base plane at the toe is on the order of 1-1/16 inches, and the spacing between the top surface and the base plane at the heel end of the sole is on the order 1-¼ inches. It is therefore seen that spacings of the top surface from the base plane at the front and rear ends of the sole are substantially equal.

Figure 4:
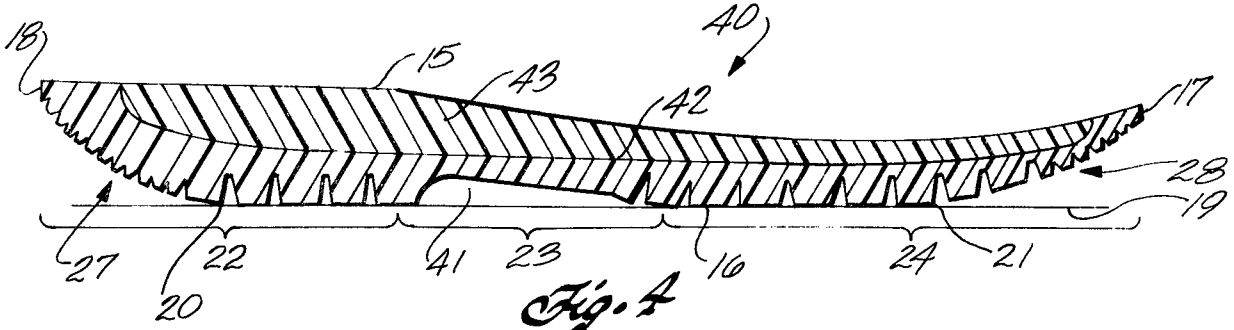
FIG. 4 is a longitudinal cross-sectional elevation view of another sole.

Another sole 40 according to this invention is shown in longitudinal cross-sectional elevation in FIG. 4. To the extent that sole 40 has features corresponding to the previously described features of sole 10, like character numbers are used with reference to sole 40 as have previously been used in the description of sole 10. Sole 40 differs from sole 10 by having an arch recess 41 in tread surface 16 which is substantially shallower than arch recess 34 of sole 10. Another difference between soles 40 and 10 is that sole 40 has an elongate recess 42 defined in its top surface 15. Recess 42 is defined inwardly of the periphery of sole 40 and extends from adjacent heel end 18 to adjacent toe end 17. A quantity of resilient, spongy cushion material 43 is disposed in recess 42 so that its upper extent is substantially coplanar with top surface 15 peripherally of the recess. The enlarged size of recess 42 relative to recesses 29 and 32 of sole 10 provides increased reduction in the weight of sole 40. However, the presence of cushion material 43 in recess 42 allows a boot, in which sole 40 is a component, to be substantially cushioned for a user, particularly under the location of his heel.

Figure 5:
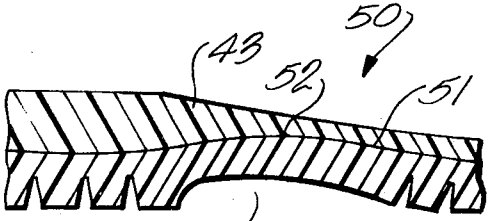
FIG. 5 is a fragmentary cross-sectional elevation view of another sole.

FIG. 5 is a fragmentary longitudinal cross-sectional elevation view of another sole 50. Sole 50 is similar to sole 40 except that it has a top surface recess 51 which has substantially the same peripheral outline as recess 42. Recess 51 does not have a flat bottom surface 52 in the vicinity of arch recess 41, whereas recess 42 has a flat bottom over arch recess 41. Instead, in sole 50 the recess bottom surface 52 is raised in the vicinity of the arch recess so that the sole member is of substantially uniform thickness across the longitudinal extent of sole recess 41. Recess 51 is filled with a quantity of resilient cushion material 43.

Figure 6:
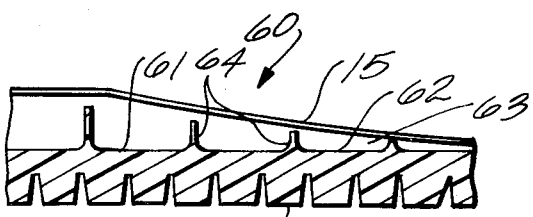
FIG. 6 is a fragmentary cross-sectional elevation view of yet another sole.
Figure 7:
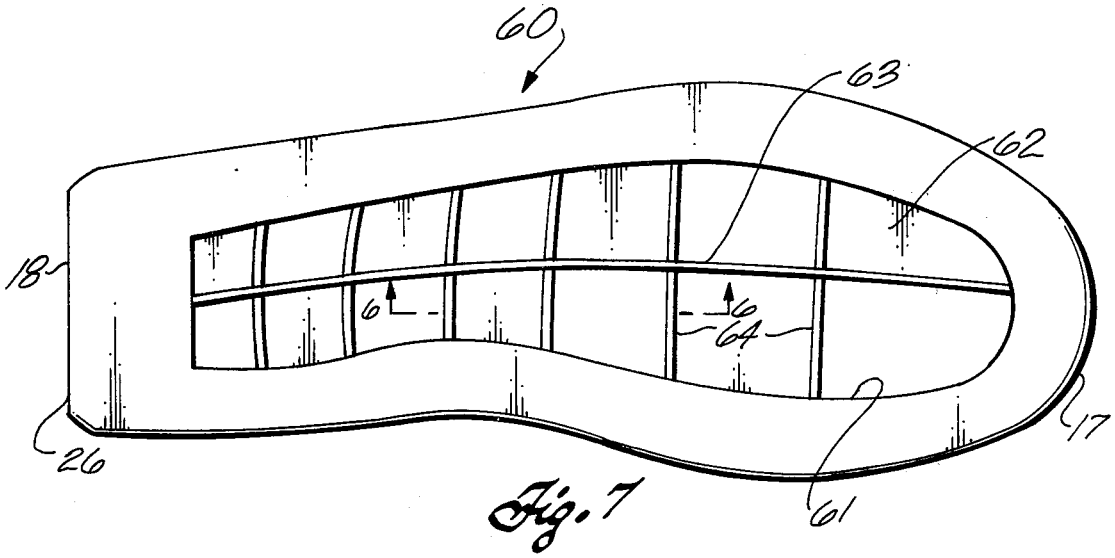
FIG. 7 is a top plan view of the sole of which a portion is illustrated in FIG. 6.

FIG. 6 is a fragmentary cross-sectional elevation view, similar to FIGS. 4 and 5, of another sole 60 according to this invention; the entire sole 60 is shown in top plan view in FIG. 7. Sole 60 has no arch recess. Thus, the tread surface 16 of sole 60 is disposed in base plane 19 over the entire portion of the length of the sole between locations 20 and 21 which correspond to the forward and rear limits of curved heel and toe configurations 27 and 28, respectively. The top surface of sole 60 defines a recess 61 which is similar in shape and depth, including the configuration of bottom surface 62, to recess 42 of sole 40. The width of recess 61 is bisected by a central stiffening rib 63 which extends the length of the recess substantially along the longitudinal centerline of the sole. Rib 63 has its upper edge spaced below top surface 15 by a distance which is substantially equal to the depth of recess 30 encountered in sole 10. Rib 63 provides enhanced resistance to flexing or bending of sole 60 about lines transversely of its length. Thinner and shorter transverse ribs 64 extend from the side walls of recess 61 to longitudinal rib 63 at spaced locations along the length of the recess. Ribs 64 provide local stiffness to the sole and to prevent rib 63 from buckling in use. The upper edges of ribs 64 are located closer to the bottom surface 62 of recess 61 than is the upper edge of rib 63. Recess 61 may or may not be filled with resilient cushioning material 43, as desired.

The configuration of a sole according to this invention, when viewed from the side (see FIG. 3), is similar to the configuration of a shoe or boot sole after extended use and wear. A shoe or boot sole tends to wear in manners and in locations which lead to a reduction in muscle action required for walking. The present soles have this "used" configuration as initially manufactured. It is therefore seen that the present soles enable a boot in which they are incorporated to be used from the outset more efficiently and comfortably, i.e., with less muscle action, than is the case with soles of more conventional configuration.

As shown in FIG. 1, tread surface 16 of sole 10, as well as of the other soles described above, is locally relieved, recessed and contoured to define a desired pattern of lugs, cleats, ribs, dimples, ridges or the like. The particular topography of the tread surface, apart from heel and toe configurations 27 and 28 and apart from the arch recesses described above, are not a part of this invention and may be defined as desired with an eye to the particular intended use of the boot. The tread surface configuration shown in FIG. 1 is believed to be useful where the sole is used on a hiking boot or rock climber's boot.

Referring to FIG. 2, broken line 39 represents the outline of the boot upper 12 in the vicinity of the boot heel. It will be seen that when sole 10 is applied to a boot having a conventional upper construction, the rear corners of the sole 10, and preferably also middle sole 13, project outwardly from the boot upper to define ears or lugs at the rear corners of the boot. These lugs result from the increased width of the boot at the heel end thereof and are desirable to afford substantial line contact between the sole and the ground as a hiker, for example, makes first contact with the ground in taking a step forward.

Workers skilled in the art to which this invention pertains will readily appreciate that the present invention has been described above with reference to presently preferred structural arrangements for the purposes of example in furtherance of an explanation of the principles of this invention. The foregoing description is not exhaustive of all embodiments and forms which this invention may take. Modifications, alterations and variations in the arrangements described above may be practiced without departing from the scope of this invention while relying on and taking advantage of the advances which this invention provides. Accordingly, the foregoing description should not be considered as limiting the scope of this invention.

What is claimed is:

1. A sole member adapted to be affixed to an upper portion of a hiking boot and the like, the sole member having a heel portion at a rear end thereof, a toe portion at a front end thereof, a top surface and a bottom tread surface, the tread surface between first and second locations intermediate the ends of the sole member being disposed in a base plane of the sole member, the rear end of the sole member having a distinct substantially straight extent substantially perpendicular to the length of the sole member whereby the sole member has a substantially square heel when viewed from the top, the tread surface being curved concave upward proceeding rearwardly therealong from the first location so that the heel portion when viewed from the side along a line substantially parallel to the top surface has a first curved configuration in which the tread surface extends substantially cylindrically curvilinearly away from the base plane substantially to the top surface to the substantially straight extent of the sole member at the rear end thereof, the tread surface being curved concave upward proceeding forwardly therealong from the second location so that the toe portion when viewed from the side along said line has a second curved configuration in which the tread surface extends curvilinearly away from the base plane substantially to the top surface, whereby in use of a hiking boot and the like incorporating the sole member the configuration of the sole member tread surface adjacent the rear end of the member affords substantially line contact between the sole and a ground surface and tends to direct the boot and the like to roll straight ahead.

2. A sole member according to claim 1 wherein the sole member is substantially stiff and resistant to flexing in directions transversely of its elongate extent.

3. A sole member according to claim 1 wherein the curvatures of the tread surface in the first and second configurations are substantially cylindrical, each cylinder having a directrix substantially parallel to the base plane and substantially perpendicular to the elongate extent of the sole member.

4. A sole member according to claim 3 wherein each cylinder is of progressively greater curvature proceeding therealong toward the sole end associated therewith.

5. A sole for hiking boots and the like comprising an elongate sole member adapted to be affixed to an upper portion of a boot, the sole member having a heel portion at a rear end thereof, a toe portion at a front end thereof, an arch portion intermediate the heel and toe portions along the length of the sole member, a top surface and a bottom tread surface, the tread surface forwardly and rearwardly of the arch portion being disposed in a base plane of the sole member, the rear end of the sole member having a distinct substantially straight extent substantially perpendicular to the length of the sole member whereby the sole member has a substantially square heel shape when viewed along a line substantially normal to the top surface, the tread surface being curved concave upward proceeding rearwardly therealong from adjacent the arch portion through the rear extent of the heel portion so that the heel portion, when viewed from the side along a line substantially parallel to the top surface, has a first curved configuration in which the tread surface extends substantially cylindrically curvilinearly away from the base plane substantially to the top surface to the substantially straight extent of the sole member at the rear end thereof, the tread surface being curved concave upward proceeding forwardly therealong from adjacent the arch portion so that the toe portion, when viewed from the side along said parallel line, has a second curved configuration in which the tread surface extends away from the base plane substantially to the top surface, the top surface at the front and rear ends of the sole member being spaced substantially equally from the base plane, whereby in use of a hiking boot and the like incorporating the sole member the configuration of the sole member tread surface adjacent the rear end of the member affords substantially line contact between the sole and a ground surface and tends to direct the boot and the like to roll straight ahead.

6. A sole according to claim 5 wherein the straight extent of the sole member at the rear end thereof is a substantial fraction of the overall width of the sole member.

7. A sole according to claim 6 wherein said fraction is on the order of at least about one-half.

8. A sole according to claim 5 wherein the sole member is substantially stiff and resistant to flexing in directions transversely of its elongate extent.

9. A sole according to claim 8 wherein the top surface is recessed over a substantial portion of its area, and rib means raised from the bottom of the recess toward the top surface and extending substantially parallel to the elongate extent of the sole member.

10. A sole according to claim 5 wherein the top surface is recessed over a substantial portion of its area inwardly of the periphery thereof.

11. A sole according to claim 10 wherein the sole member is defined of a relatively hard material, and including a quantity of resilient cushion material disposed in the recess.

12. A sole according to claim 5 wherein the curvatures of the tread surface in the first and second configurations are substantially cylindrical, each cylinder having a directrix substantially parallel to the base plane and substantially perpendicular to the elongate extent of the sole member.

13. A sole according to claim 12 wherein the cylinders are substantially faired into the base plane at the ends of said configurations inwardly of the ends of the sole member.

14. A sole according to either one of claims 12 and 13 wherein each cylinder is of progressively greater curvature proceeding therealong toward the corresponding end of the sole member.

15. A sole according to claim 5 wherein, in the arch portion, the tread surface defines a recess which extends across the width of the sole member and for a selected distance along the length of the sole member.

16. A sole according to claim 15 wherein the recess has a rear wall disposed substantially normal to the base plane.

17. A sole according to claim 5 wherein the tread surface throughout the arch portion is disposed in the base plane.

18. In a hiking boot and the like having a substantially stiff and inflexible sole construction, an improved sole member having a bottom tread surface configured to provide substantial guided rolling action of the boot along a ground surface thereby to reduce muscle fatigue, the tread surface having a heel portion at a rear end thereof, a toe portion at a front end thereof, and a top surface connected to an inner sole of the boot, the tread surface between first and second locations intermediate the ends of the sole member being disposed in a base plane of the sole member, the rear end of the sole member having a distinct substantially straight extent substantially perpendicular to the length of the sole member whereby the sole member has a substantially square heel when viewed from the top, the tread surface being curved concave upward proceeding rearwardly therealong from the first location so that the heel portion when viewed from the side along a line substantially parallel to the top surface has a first curved configuration in which the tread surface extends substantially cylindrically curvilinearly away from the base plane substantially to the top surface to the substantially straight extent of the sole member at the rear end thereof, the tread surface being curved concave upward proceeding forwardly therealong from the second location so that the toe portion when viewed from the side along said line has a second curved configuration in which the tread surface extends curvilinearly away from the base plane substantially to the top surface.

* * * * *